United States Patent [19]

Danley et al.

[11] Patent Number: 4,770,087

[45] Date of Patent: Sep. 13, 1988

[54] GARAGE DOOR VENTILATOR

[76] Inventors: Emory L. Danley, 8309 NW. 39, Bethany, Okla. 73008; James Norman, Central Park II S. 115, 515 Central Park Dr., Oklahoma City, Okla. 73105

[21] Appl. No.: 98,643

[22] Filed: Sep. 21, 1987

[51] Int. Cl.[4] ..... E06B 1/04

[52] U.S. Cl. ..... 98/87; 49/168; 52/207; 98/99.8; 160/92

[58] Field of Search ..... 52/207; 98/87, 100.05, 98/99.8; 160/92, 113, 201, 394; 49/64, 168, 171

[56] References Cited

U.S. PATENT DOCUMENTS

| | | | |
|---|---|---|---|
| 276,219 | 4/1883 | Boisen | 160/92 |
| 1,472,663 | 10/1923 | Miller | 160/92 |
| 1,745,121 | 1/1930 | Schueler | 49/62 |
| 1,935,254 | 11/1933 | Swanson | 49/171 |
| 2,000,366 | 5/1935 | Victor | 160/92 |
| 2,347,137 | 4/1944 | Steele | 98/99.8 |
| 3,165,143 | 1/1965 | Jackwig | 160/201 |
| 3,178,776 | 4/1965 | Stansberry . | |
| 4,048,756 | 9/1977 | Lawrence | 98/87 |
| 4,095,640 | 1/1978 | Beckerer | 49/394 |
| 4,141,403 | 2/1979 | Church | 160/201 |
| 4,662,270 | 5/1987 | Fiddler | 98/87 |

*Primary Examiner*—Henry E. Raduazo
*Attorney, Agent, or Firm*—Robert K. Rhea

[57] ABSTRACT

A weatherproof ventilating insert for a garage door or the like having a plurality of sections normally closed by imperforate panels. At least one of the panels is provided with an aperture. A pair of frames, including sun rays and rain shielding louvers in one frame, are disposed on respective opposite sides of the panel for receiving sheet material between the frames which may be a section of screening or an imperforate panel or both.

4 Claims, 1 Drawing Sheet

GARAGE DOOR VENTILATOR

BACKGROUND OF THE INVENTION

1. Field of the Invention

The present invention relates to garage doors and more particularly to a weather proof ventilating insert for an opening in the door.

Many residential home owners have a free standing or dwelling attached garage normally housing their automobile. Such garages are conventionally opened and closed by an overhead door of a size admitting the entry of an automobile. Many garage doors are formed by multiple sections hingedly connected along horizontal hinge axes thus providing a series of panels excluding the elements when the door is in closed position. Many home owners utilize the garage space for purposes other than auto storage, such as in an attached garage, installing a laundry area in a portion thereof, and/or as a play area for children. Such uses of the garage make it desirable that some form of ventilation be provided and yet provide privacy for the equipment or occupants.

This invention accomplishes that purpose, namely, by providing a selective ventilating or element excluding insert for selected panel sections of a garage door.

2. Description of the prior art

The prior art discloses inserting various ornamental panels in an opening in a garage door for decorative appearance of the door or glass panes for admitting additional light.

The most pertinent prior patent is believed U.S. Pat. No. 3,178,776. This patent discloses a plurality of planar panels, each slightly greater in overall dimensions than a door opening to be covered, particularly for decorative purposes. The peripheral edge of each selected panel, when thus disposed over the opening in the door is held in place by a metal glazing strip attached to the garage door area surrounding the panel.

This invention is distinctive over this and other such patents by providing a weather element excluding insert for an aperture formed in a garage door panel which admits or excludes ambient air in a ventilating or non-ventilating arrangement.

SUMMARY OF THE INVENTION

In a conventional overhead garage door characterized by a plurality of generally rectangular sections closed by planar panels, a rectangular opening is formed in one or more of the panels. A pair of open frame members are mounted to opposing outer and inner sides of the apertured panel around the perimeter of the aperture. Sections of sheet material, spanning the area of the aperture, are interposed between the frames for screening or closing the aperture. Sun rays and rain excluding louvers are installed on the outermost frame.

The principal object of this invention is to provide ventilating or closing inserts for openings in an existing garage door or as original equipment by the manufacturer wherein the inserts selectively ventilate while excluding sun rays and rain or close the opening.

DESCRIPTION OF THE PREFERRED EMBODIMENTS

Figure 1:
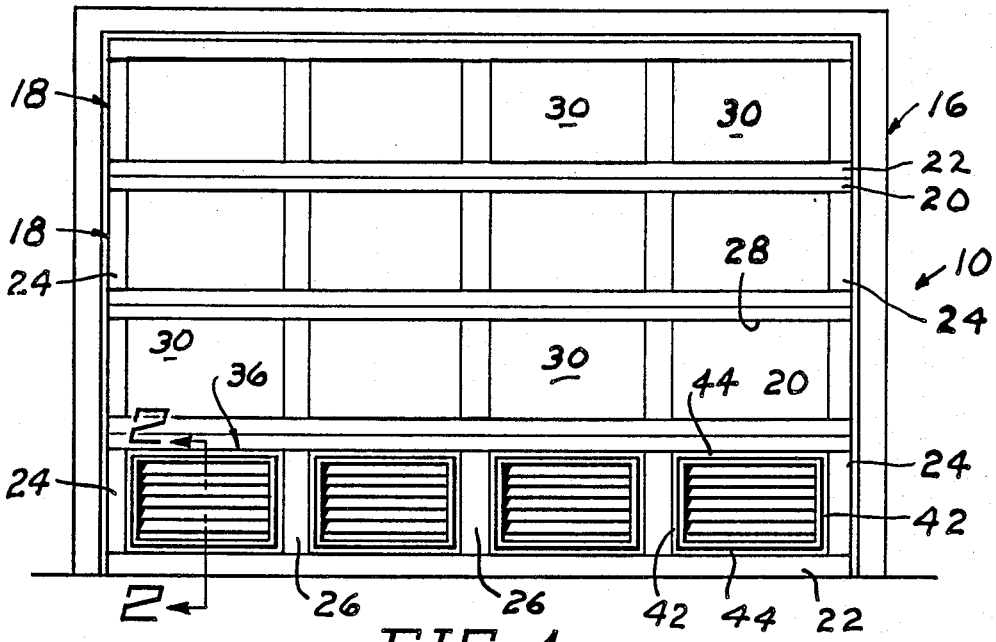
FIG. 1 is an elevational view of a garage door in closed position having a series of the ventilating inserts installed thereon; and, FIG. 2 is a vertical cross sectional view, to a larger scale, taken substantially along the line 2—2 of FIG. 1.
Figure 2:
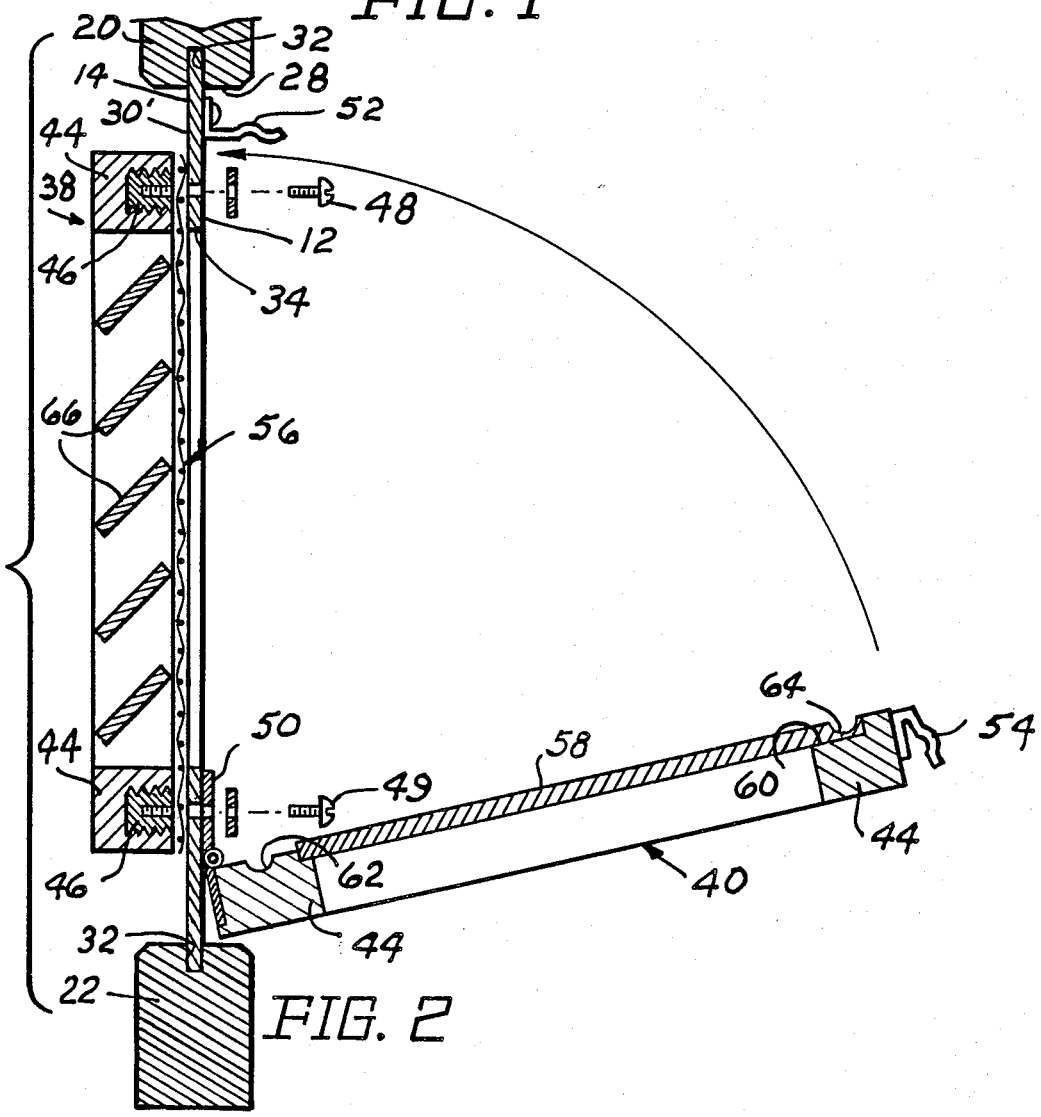

Like characters of reference designate like parts in those figures of the drawings in which they occur.

In the drawings:

The reference numeral 10 indicates a substantially conventional garage door, having inner and outer surfaces 12 and 14, disposed within a door frame 16 for opening and closing a garage, not shown. The garage door illustrated is of the overhead opening type formed by horizontal hingedly connected sections 18, each extending the width of the door opening and spanning the full height thereof in a manner conventional with overhead travel doors for a garage opening and closing action. Each of the door sections 18 are formed by top and bottom rails 20 and 22, respectively, extending the full width of the door and being interconnected at the respective ends thereof by stiles 24.

Mullions 26 extend in parallel spaced relation to the stiles and between the rails intermediate the ends thereof to form a plurality of openings 28 in the respective door section 18. Each of the openings 28 is closed by a planar panel 30. A peripheral edge portion of each panel 30 is nested by a surrounding groove 32 formed in the adjacent edge surface of the respective rail 20–22 and stile or mullion. One or more of the panels 30 is centrally apertured, as at 34 and hereinafter referred to as number 30', to describe a preferably rectangular aperture with the perimeter of the aperture parallel with and uniformly spaced from the edges of the rails, stile and/or mullions.

The aperture 34 is surrounded by frame means 36 for selectively opening or closing the aperture.

The frame means 36 comprises a pair of frames, an outer frame 38 and an inner frame 40. Each of the frames 38 and 40 are defined by a pair of laterally spaced uprights 42 interconnected at their respective ends by horizontal bars 44 forming an open rectangular frame dimensioned to overlap a portion of the panel 30' defining the perimeter of the aperture 34. The bars 44 of the frame 38 are each provided with at least one threaded socket insert 46 open to its surface facing the outer surface 14 of the panel 30', for the purpose of receiving screw means 48 and 49 projecting through the panel 30' and securing the frame 38 to the panel. The other frame 40 has its lower-most bar 44 connected with one flange of a hinge means 50, such as a piano hinge, with the other flange of the hinge means 50 secured to the panel 30' by the screw means 49 for vertical pivoting movement of the frame 40 about the horizontal axis of the hinge means. The frame 40 being normally maintained in closed position against the inner surface 12 of the panel 30' by a conventional fastener, such as spring clip means 52 and 54, secured respectively to the inner surface of the panel portion and uppermost arm of the frame 40.

One or both of sheet means 56 and 58 are interposed between the frame means and the apertured panel in overlapping relation with respect to the perimeter of the panel forming the aperture 34. The sheet means 56 comprises a section of screen material interposed between the frame 38 and the outer surface 14 of the panel and is held in place by the frame and screw means 48 and 49. Obviously, the purpose of the screen is to exclude insects or small animals from the garage enclosure.

The other sheet means 58 comprises in imperforate section of selected material, such as wood or plastic, rectangular in overall configuration and at least equal in area to the area defined by the aperture 34. The peripheral edge of the sheet 58 is nested by a rabbeted edge 60 formed in the inner surface of the frame 40 contiguously contacting the panel 30' inner surface 12 and forms a substantially airtight aperture closure member in combination with the frame. The lower bar of the frame 40 is formed with a groove or socket 62 nesting the head of the screw means 49 while the upper peripheral edge portion of the sheet 58 is similarly provided with a groove or socket 64 nesting the head of the screw means 48. Obviously, other sections of sheet material may be interposed between the frame 40 and the periphery of the aperture 34, such as glass or thermoplastic material, neither of which are shown.

The other frame 38 is further provided with a series of horizontally disposed louvers 66 extending in outward and downwardly inclined relation between and connected at their respective ends with the frame uprights 42 for excluding sun rays or rain from the panel aperture 34.

Obviously the invention is susceptible to changes or alterations without defeating its practicability. Therefore, I do not wish to be confined to the preferred embodiment shown in the drawings and described herein.

I claim:

1. In a garage door having inner and outer surfaces and normally closing an enclosure and having a plurality of horizontally disposed hingedly joined door sections each extending the width of a door opening and spanning the full height thereof, said door sections each comprising a pair of rails having interconnecting stiles extending between the respective ends thereof and having mollions disposed in parallel spaced relation to each other and to said stiles and intermediate the ends of said rails for providing equal sized openings therebetween and having panels normally cloding the openings with at least one of the panels having a central generally rectangular aperture, the improvement comprising:

frame means spanning the panel aperture in perimeter overlapping contiguous contacting relation, said frame means including a pair of open frames disposed, respectively, on the inner and outer surfaces of said apertured panel, each frame of said pair of frames comprising a pair of uprights interconnected at their respective ends by a pair of bars;

means including fasteners securing said pair of frames to said apertured panel;

means hingedly connecting at least one frame of said pair of frames with the apertured panel adjacent the aperture therein; and, sheets means including a section of screen material and a rigid imperforate planar sheet removably interposed between the hingedly connected frame of said pair of frames and said apertured panel spanning the panel aperture and interposed between the frame means and the perimeter of the aperture for selectively admitting or excluding ambient air to the enclosure, said hinged frame having a rabbeted inner edge disposed adjacent the apertured panel for nesting an edge portion of the imperforate sheet perimeter.

2. The combination according to claim 1 and further including:

louver means extending horizontally between said frame uprights of one frame of said pair of frames for shielding the enclosure.

3. A ventilating insert for a door having a panel and having a polygonal shaped aperture therethrough, comprising:

frame means spanning the panel aperture in perimeter overlapping contiguous contacting relation, said frame means including a pair of open frames disposed, respectively, on the inner and outer surfaces of said apertured panel, each frame of said pair of frames comprising a pair of uprights interconnected at their respective ends by a pair of bars;

means including fasteners securing said pair of frames to said apetured panel;

means hingedly connecting at least one frame of said pair of frames with the apertured panel adjacent the aperture therein; and, sheet means including a section of screen material and a rigid imperforate planar sheet interposed between the hingedly connected frame of said pair of frames and said apertured panel spanning the panel aperture and interposed between the frame means and the perimeter of the aperture for selectively passing or excluding ambient air movement through the door aperture, said hinged frame having a rabbeted inner edge disposed adjacent the apertured panel for removably nesting an edge portion of the imperforate sheet perimeter.

4. The insert according to claim 3 and further including:

louver means extending horizontally between said frame uprights of one frame of said pair of frames for shielding the enclosure.

* * * * *